US008602850B2

(12) United States Patent
Park et al.

(10) Patent No.: US 8,602,850 B2
(45) Date of Patent: Dec. 10, 2013

(54) POWER SANDER HAVING A SANDING PLATE LOCKING MECHANISM

(75) Inventors: Keith Park, Jiangsu Province (CN); Lee Dawson, Jiangsu Province (CN)

(73) Assignee: Chervon Limited, Wanchai (HK)

( * ) Notice: Subject to any disclaimer, the term of this patent is extended or adjusted under 35 U.S.C. 154(b) by 444 days.

(21) Appl. No.: 12/974,497

(22) Filed: Dec. 21, 2010

(65) Prior Publication Data

US 2011/0159789 A1 Jun. 30, 2011

(30) Foreign Application Priority Data

Dec. 28, 2009 (CN) ..... 2009 1 0264712

(51) Int. Cl.
*B24B 41/00* (2006.01)

(52) U.S. Cl.
USPC ..... 451/359

(58) Field of Classification Search
USPC ..... 451/359
See application file for complete search history.

(56) References Cited

U.S. PATENT DOCUMENTS

| | | | | |
|---|---|---|---|---|
| 5,601,483 | A * | 2/1997 | Rudolf et al. | 451/359 |
| 6,569,001 | B2 * | 5/2003 | Rudolf et al. | 451/344 |
| 2003/0190877 | A1 * | 10/2003 | Gallagher et al. | 451/344 |
| 2008/0014844 | A1 * | 1/2008 | Pontieri | 451/359 |

* cited by examiner

*Primary Examiner* — Maurina Rachuba
(74) *Attorney, Agent, or Firm* — McDermott Will & Emery LLP

(57) ABSTRACT

A sander according to the present application provides a sander with a rotatable plate which can be locked by hand. Specifically, the sander of the present application has a main body and a sanding head mounted below the main body. The main body has a housing, a motor and a coupling mechanism contained in the housing. The sanding head has a sanding plate rotatably connected to the base plate and the base plate and/or the sanding plate may be connected to the coupling mechanism. The base plate may also have a locking means to lock the sanding plate. The sanding head of the present application may also have a rotatable sanding plate to allow for more efficient use of the sanding paper and a locking means that can be used to lock the sanding plate to provide simpler, easier and more reliable manual locking.

13 Claims, 4 Drawing Sheets

POWER SANDER HAVING A SANDING PLATE LOCKING MECHANISM

CROSS-REFERENCE TO RELATED APPLICATIONS

This application claims priority under 35 U.S.C. §119 to CN 200910264712.3 filed Dec. 28, 2009, which may be hereby incorporated by reference.

FEDERALLY SPONSORED RESEARCH OR DEVELOPMENT

Not Applicable.

TECHNICAL FIELD

The present invention relates to a power tool and more specifically to a power sander.

BACKGROUND OF THE INVENTION

A power sander generally has a housing and a sanding plate mounted below the housing. A motor and transmission are located within the housing, and the sanding plate is connected to an output end of the transmission. In order to use the power sander, sanding paper is attached to the bottom of the sanding plate.

As is well known to those of ordinary skill in the art, prior sanding plates were fixed to the housing and as a result the abrasion level of the sanding paper would be inconsistent due to the different forces applied to the sander during use. As a result of the different forces, the usage life of the sanding paper would be decreased. In order to prolong the usage life of the sanding paper, the prior art required a user to frequently change or rotate the mounting position of the sanding paper. As a result, not only was the replacement of the sanding paper a difficult process, but it also diminished the length of use of the sanding paper.

Chinese Patent No. 9228886, discloses a sander with a rotatable sanding plate. By using the rotatable sanding plate, the usage time of the sanding plate increased and the efficiency of the sander was improved. However, the sanding plate was retained only by a spring or a steel ball. As a result, if the sander was used for a long time or was used under heavy load conditions, the sanding plate would easily shift from the pre-set direction relative to the sander which would negatively impact the normal operation by a user.

SUMMARY OF THE INVENTION

The present application has a sander with a rotatable plate which can be locked by hand that overcomes the defects of the prior art explained above. More specifically, the sander of the present application has a main body and a sanding head mounted below the main body. The main body has a housing, a motor and a coupling mechanism contained in the housing. The sanding head has a sanding plate rotatably connected to the base plate and the base plate and/or the sanding plate may be connected to the coupling mechanism. The base plate may also have a locking means with a cam element which can be used to lock the sanding plate. Further, the sanding head of the present application may have a rotatable sanding plate to allow the sanding paper attached to the sanding plate to be used more effectively, and the base plate may have a cam shaped locking means that can be used to lock the sanding plate to provide simpler, easier and more reliable manual locking.

BRIEF DESCRIPTION OF THE DRAWINGS

To understand the present invention, it will now be described by way of example, with reference to the accompanying drawings in which.

DETAILED DESCRIPTION

Figure 1:
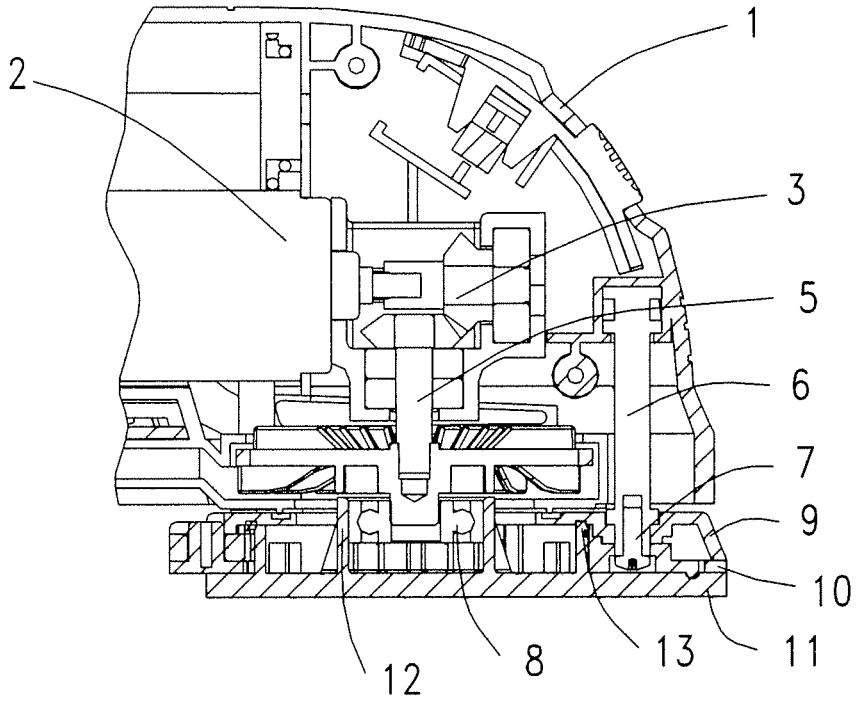
FIG. 1 is a sectional view of a sander according to the present application.

As shown in FIG. 1, a sander according to a first embodiment of the present application comprises a housing 1, a motor 2, a transmission 3 and an output shaft 5 disposed in the housing 1. A bracket 6 is connected to the housing 1 and a bearing is indirectly connected to the shaft 5. The bearing 8 is not limited to being connected to the output shaft 5, and in other embodiments, the bearing may be connected to the motor shaft and may be an eccentric bearing. The bearing 8 is fixed on a rotatable sanding plate 11 via a hole 12 formed on the sanding plate 11. The rotatable sanding plate 11 is mounted on a triangular base plate 10 by a clamping rims-slots member 13. The triangular base plate 10 is non-rotatably connected to the housing 1 either directly or indirectly. In one embodiment, the triangular base plate 10 is fastened to the bracket 6 via a locking screw 7.

Figure 2:
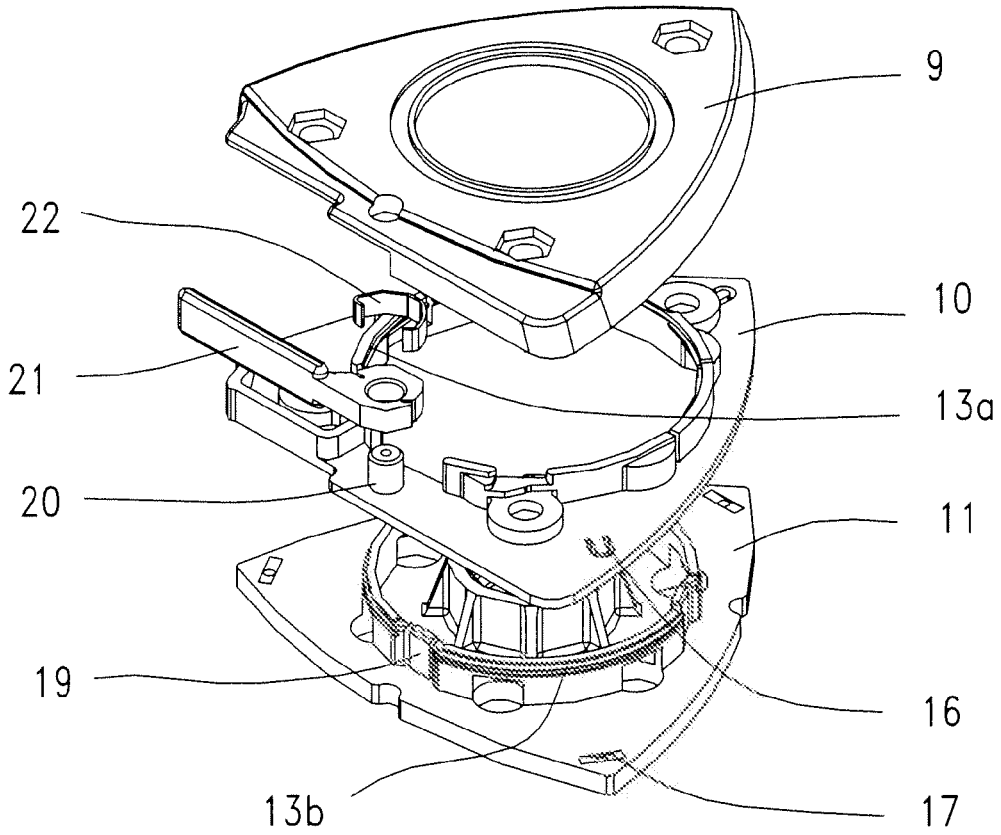
FIG. 2 is an exploded view of the sanding head of the sander shown in FIG. 1.

As shown in FIG. 2, the sanding head comprises a triangular cover plate 9, the triangular base plate 10 and the rotatable sanding plate 11 which are connected together. The base plate 10 may be provided with a circumferential slot 13*a* and the sanding plate 11 may be provided with a circumferential rim 13*b*. When the rim 13*a* is pushed into the slot 13*b*, the sanding plate 11 will be coupled to the base plate 10. The base plate 10 may have resilient protrusions 16 and the sanding plate 11 may have corresponding retaining slots 17 to receive and engage the protrusions 16.

Figure 5:
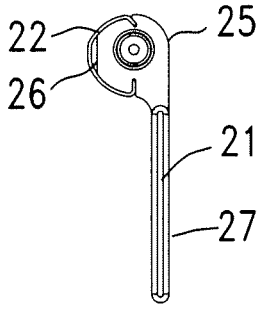

The rear end of base plate 10 may have a column 20, and a locking lever means 21 may be rotatably set on the column 20 using the hole in the locking lever means 21. With reference to FIG. 5, one end of the locking means 21 may be shaped like a cam, and the cam may include a locking portion 26 shaped as a larger circular arc and a release portion 25 shaped as a smaller circular arc. Further, one end of the locking portion 26 may be shaped into a straight portion by cutting a section of the arc, and a spring sheet 22 may be sleeved on the locking portion 26. This design makes it possible to provide a return gap between the locking portion 26 and the spring sheet 22. Also, according to the present application, because the spring sheet 22 and recessed ribs 19 are resilient, the friction between the locking means 21 and the sanding plate 11 is reduced, and the operation lifetime of the sander will be prolonged.

In addition, the triangular cover plate 9 and triangular base plate 10 are designed with a recess to allow a user's hand to access and easily pull the locking lever means 21. Both the cover plate 9 and base plate 10 may be set with the same stop rim 24 for retaining the locking means 21 when the locking means 21 is in the locked position. After the sanding plate 11 is tightly locked on the base plate 10, the back face 27 of the lever and the back edge 28 of the base plate 10 are on a plane.

Figure 3:
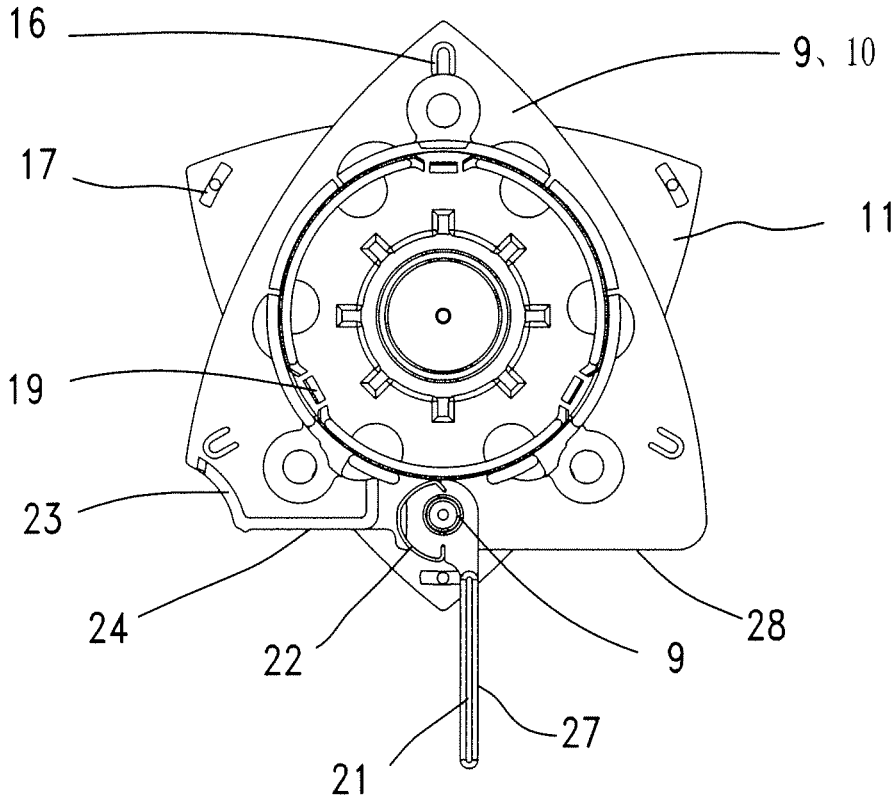
FIG. 3 is a bottom view of the sanding plate in the released position according to the present application.

With reference to FIG. 3, the sanding plate 11 is in the released position. The resilient protrusions 16 and the retaining slots 17 are separated from each other, and the spring sheet 22 is also detached from the recessed ribs 19 formed on the sanding plate 11. As a result the sanding plate 11 can be freely rotated on the base plate 10.

Figure 4:
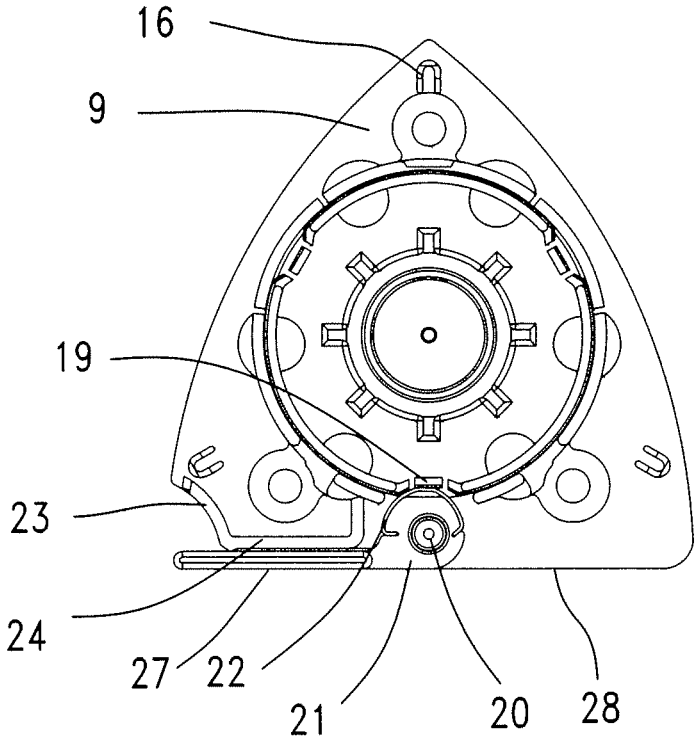
FIG. 4 is a bottom view of the sanding plate in the locked position according to the present application; and, FIG. 5 is a top view of the locking means according to the present application.

With reference to FIG. 4, the sanding plate is in the locked position. The sanding plate 11 can be moved from a first locked position to another locked position by rotating it 120° relative to the base plate 10 until it coincides with the base plate 10 and the resilient protrusions 16 slide into the retaining slots 17. The locking means 21 also rotates around the column 20 into the stop rim 24 with the spring sheet 22 engaged with the recessed ribs 19 to provide for locking of the sanding plate 11 in a new position.

The above-mentioned embodiments only describe the conception and the principle of the present invention without limitation to the contents of the invention. One skilled in the art could realize that the present invention has additional equivalent embodiments and obvious modifications which are still included in the scope of the present invention defined by the appended claims.

What is claimed is:

1. A sander comprising:

a main body comprising a housing, a motor, and a coupling mechanism contained in the housing;

a sanding head mounted below the main body having a base plate and a sanding plate rotatably connected to the base plate;

wherein at least one of the base plate and the sanding plate is connected to the coupling mechanism such that the base plate is provided with a locking means for securing the sanding plate to the base plate; and, wherein the locking means includes a cam element and the sanding plate has a recessed rib to receive the cam element.

2. The sander of claim 1, wherein the cam element of the locking means further includes a locking portion formed as a first larger circular arc and a release portion formed as a second smaller circular arc.

3. The sander of claim 2, wherein the locking portion is secured with a spring sheet.

4. The sander of claim 2, wherein one end of the locking portion is shaped into a straight portion by cutting a portion of the arc.

5. The sander of claim 1, wherein the base plate is provided with a recess and a stop rim.

6. The sander of claim 1, wherein the base plate has resilient protrusions arranged to engage with retaining slots formed on the sanding plate.

7. The sander of claim 1, further comprising a bracket with a first end linked to the housing and a second end connected to the base plate.

8. The sander of claim 1, further comprising a cover plate disposed on top of the base plate.

9. A sander comprising:

a main body;

a sanding head mounted below the main body, wherein the main body has a housing, a motor and a coupling mechanism contained in the housing and the sanding head has a base plate and a sanding plate rotatably connected to the base plate;

the base plate having a recess and a stop rim and resilient protrusions arranged to engage with retaining slots formed on the sanding plate;

further wherein at least one of the base plate and the sanding plate is connected to the coupling mechanism such that the base plate is provided with a locking means having a cam element for securing the sanding plate to the base plate;

a bracket with a first end linked to the housing and a second end connected to the base plate; and, a cover plate disposed on top of the base plate.

10. The sander of claim 9, wherein the sanding plate has a recessed rib to receive the cam element of the locking means.

11. The sander of claim 9, wherein the cam element of the locking means further includes a locking portion formed as a first larger circular arc and a release portion formed as a second smaller circular arc.

12. The sander of claim 11, wherein the locking portion is secured with a spring sheet.

13. The sander of claim 11, wherein one end of the locking portion is shaped into a straight portion by cutting a portion of the arc.

* * * * *